US006870449B2

(12) United States Patent
Kitamori et al.

(10) Patent No.: US 6,870,449 B2
(45) Date of Patent: Mar. 22, 2005

(54) HIGH-FREQUENCY TRANSMISSION LINE

(75) Inventors: Nobumasa Kitamori, Yokohama (JP); Atsushi Saitoh, Yokohama (JP); Kei Matsutani, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/318,203

(22) Filed: Dec. 13, 2002

(65) Prior Publication Data

US 2003/0112092 A1 Jun. 19, 2003

(30) Foreign Application Priority Data

Dec. 18, 2001 (JP) ..... 2001-384905

(51) Int. Cl.[7] ..... H01P 1/26; H01P 1/22; H01P 3/16

(52) U.S. Cl. ..... 333/251; 333/22 R; 333/248; 333/81 B

(58) Field of Search ..... 333/251, 239, 333/248, 81 B, 22 R

(56) References Cited

U.S. PATENT DOCUMENTS 3,783,401 A * 1/1974 Oltman, Jr. ..... 330/287
5,469,128 A * 11/1995 Kawanishi et al. ..... 333/22 R
5,920,245 A * 7/1999 Ishikawa et al. ..... 333/248
6,094,106 A * 7/2000 Kishino et al. ..... 333/22 R
6,441,698 B1 * 8/2002 Matsutani et al. ..... 333/81 B
6,657,514 B1 * 12/2003 Tokudera et al. ..... 333/81 B

FOREIGN PATENT DOCUMENTS

EP 0767507 B1 4/1997
JP 57166701 10/1982

OTHER PUBLICATIONS

"Millimeter Wave Integrated Circuits Using Nonradiative Dielectric Waveguide"; Tsukasa Yoneyama; Research Institute of Electrical Communication; C–I; vol. J73–C–I; No. 3, pp. 87–94; 1990.

"Design and Fabrication of a Nonradiative Dielectric Waveguide Circulator"; Hiroyuki Yoshinaga, et al.; IEEE Transactions on Microwave Theory and Techniques; vol. 36, No. 11; pp. 1526–1529; Nov. 1988.

* cited by examiner

*Primary Examiner*—Stephen E. Jones
(74) *Attorney, Agent, or Firm*—Dickstein, Shapiro, Morin & Oshinsky, LLP.

(57) ABSTRACT

In a high-frequency transmission line that is used in a high-frequency band such as the microwave band or the millimeter wave band, at least one resistive film is disposed in a plane that is substantially perpendicular to an electric field of an operating transmission mode, and the resistive film attenuates, by dielectric loss, an unwanted mode having an electric field that is perpendicular to the electric field of the operating transmission mode.

16 Claims, 21 Drawing Sheets

LSM$_{01}$ TRANSMISSION SYSTEM

RELATIONSHIP BETWEEN Q0 FACTOR OF $LSE_{01}$ RESONATOR AND TRANSMISSION CHARACTERISTICS (S21)

(b)

HIGH-FREQUENCY TRANSMISSION LINE

BACKGROUND OF THE INVENTION

1. Field of the Invention

The present invention relates to high-frequency transmission lines that are used, for example, in the microwave band or the millimeter wave band. More specifically, the present invention relates to a high-frequency transmission line having a construction that allows a high-frequency signal in an operating transmission mode to be transmitted while suppressing an unwanted mode.

2. Description of the Related Art

Various transmission lines that are used in the microwave band or the millimeter wave band have been proposed. Their transmission lines require that unwanted modes other than an operating mode to be transmitted be suppressed.

For example, H. Yoshinaga and T. Yoneyama, "Design and fabrication of a nonradiative dielectric waveguide circulator", IEEE Trans. on Microwave Theory and Tech., vol. 36, No. 11, pp 1526–1529, November (1998) discloses a transmission line including a mode suppressor for suppressing an unwanted mode. As shown in FIG. 19, according to the related art, a nonradiative dielectric line includes a metallic plate 101 disposed in a direction of transmission indicated by an arrow A, i.e., a direction that is perpendicular to an electric field associated with an operating transmission mode, so that an unwanted mode will be suppressed. In FIG. 19, 102 denotes an upper metallic plate, 103 denotes a lower metallic plate, and 104 denotes a dielectric strip. The metallic plate 101 is disposed in the dielectric strip 104.

If the $LSM_{01}$ mode the operating transmission mode and if the $LSE_{01}$ mode is an unwanted mode, the distributions of electromagnetic field vectors of these modes are as shown in FIGS. 20A and 20B, respectively. FIG. 20A shows the distribution of electromagnetic field vectors in a plane that is perpendicular to the direction of transmission of the $LSM_{01}$ mode, in which solid lines indicate electric field vectors and dashed lines indicate magnetic field vectors schematically. Similarly, FIG. 20B shows the distribution of electromagnetic fields associated with the $LSE_{01}$ mode.

The use of the metallic plate 101 allows the unwanted $LSE_{01}$ mode to be suppressed while not affecting the operating $LSM_{01}$ mode.

The use of the metallic plate 101, however, causes transmission of the TEM mode. Accordingly, it has been required to suppress the TEM wave by constructing the line so as to form a $\lambda g/4$ choke structure against the TEM wave.

The IEICE (The Institute of Electronics, Information and Communication Engineers) Trans C-1, Vol. J73-C-1 No.3, pp 87–94 (March, 1990) discloses an attenuator for a radiative dielectric line, which is shown in FIGS. 21A and 21B. Referring to FIGS. 21A and 21B, a resistive film 113 composed of nickel-chromium, having a surface resistivity of 500 $\Omega/mm^2$, is disposed between dielectric strips 111 and 112 to form an attenuator. The dielectric strips 111 and 112 are integrated by bonding. A conductor plate (not shown) is disposed on an upper surface of the dielectric strip 111, and a conductor plate is also disposed on a lower surface of the dielectric strip 112.

The resistive film 113 functions as an attenuator that suppresses transmission of the operating $LSM_{01}$ mode, and a resistive film 101 is disposed in a direction that is parallel to an electric field associated with the $LSM_{01}$ mode.

The resistive film shown in FIGS. 21A and 21B, however, functions only as an attenuator as described above, and does not serve to suppress an unwanted mode and to thereby transmit the operating transmission mode efficiently.

SUMMARY OF THE INVENTION

In order to overcome the situation described above, preferred embodiments of the present invention provide a high-frequency transmission line that efficiently suppresses an unwanted mode while not affecting an operating transmission mode, and that does not require an additional structure, such as a $\lambda_g$ choke structure, for suppressing other modes.

The present invention, in one aspect thereof, provides a high-frequency transmission line including a pair of conductor electrodes and a dielectric member disposed therebetween, the high-frequency transmission line including at least one resistive film disposed in a plane that is substantially perpendicular to an electric field of an operating transmission mode. An electric field penetrating the resistive film causes a current in the resistive film, and power associated with the current is consumed, causing a loss. The magnitude of the electric field of the unwanted mode penetrating the resistive film, which is substantially perpendicular to the operating transmission mode, is large, so that associated loss is also large. Accordingly, the excited unwanted mode is reliably suppressed by the resistive film, and the operating transmission mode is efficiently transmitted, as will be more apparent later from the description of the embodiments.

The present invention, in another aspect thereof, provides a high-frequency transmission line including a pair of conductor electrodes and a dielectric member disposed therebetween, the high-frequency transmission line including a resistive film that attenuates, by dielectric loss, an unwanted mode having an electric field that is perpendicular to an electric field of an operating transmission mode. Accordingly, the unwanted mode having the electric field that is perpendicular to the electric field of the operating transmission mode is suppressed by the dielectric loss associated with the resistive film.

Preferably, the resistive film has a surface resistivity that is greater than or equal to a surface resistivity that minimizes a Q factor of an unwanted mode that is suppressed by the resistive film in a relation between the Q factor and the surface resistivity of the resistive film. Accordingly, the resistive film acts as a dielectric member, reliably suppressing the unwanted mode by dielectric loss.

More preferably, the surface resistivity of the resistive film is in a range of 100 $\Omega/mm^2$ to 1,000 $\Omega/mm^2$. If the surface resistivity of the resistive film is smaller than 100 $\Omega/mm^2$, although the unwanted mode is suppressed, another unwanted mode could be generated, increasing loss of the operating transmission mode. If the surface resistivity is larger than 1,000 $\Omega/mm^2$, it sometimes becomes difficult to form the resistive film.

The high-frequency transmission line may include a dielectric line structure that allows transmission of the operating transmission mode and that excites a standing wave of an unwanted mode to be suppressed, wherein the resistive film is disposed in the dielectric line structure. Accordingly, the excited unwanted mode is suppressed by the resistive film.

The resistive film preferably has a length equal to or longer than $\lambda_g/2$, where $\lambda_g$ denotes a wavelength of the unwanted mode. Accordingly, the unwanted mode is attenuated by the resistive film more reliably.

Preferably, a relationship $t/\delta \leqq 0.1$ is satisfied, where t denotes a thickness of the resistive film in a direction that is substantially perpendicular to the electric field of the operating transmission mode, and δ denotes a skin depth in an operating frequency range. Accordingly, loss of the operating transmission mode is prevented.

The high-frequency transmission line may further include a resistive-film supporting base that supports the resistive film. Accordingly, even if the resistive film is thin, since the resistive film is handled as is supported by the resistive-film supporting base, the resistive film can be readily disposed in or attached to the dielectric line.

The present invention, in another aspect thereof, provides a coupler including a high-frequency transmission line according to the present invention. The present invention, in another aspect thereof, provides a communication apparatus including a high-frequency transmission line according to the present invention. The coupler and communication apparatus, which include high-frequency transmission lines according to the present invention, efficiently transmit operating transmission modes while suppressing unwanted modes.

Other features, elements, characteristics and advantages of the present invention will become more apparent from the following detailed description of preferred embodiments of the present invention with reference to the attached drawings.

DETAILED DESCRIPTION OF PREFERRED EMBODIMENTS

The present invention will now be made more apparent by describing preferred embodiments thereof.

Figure 1A:
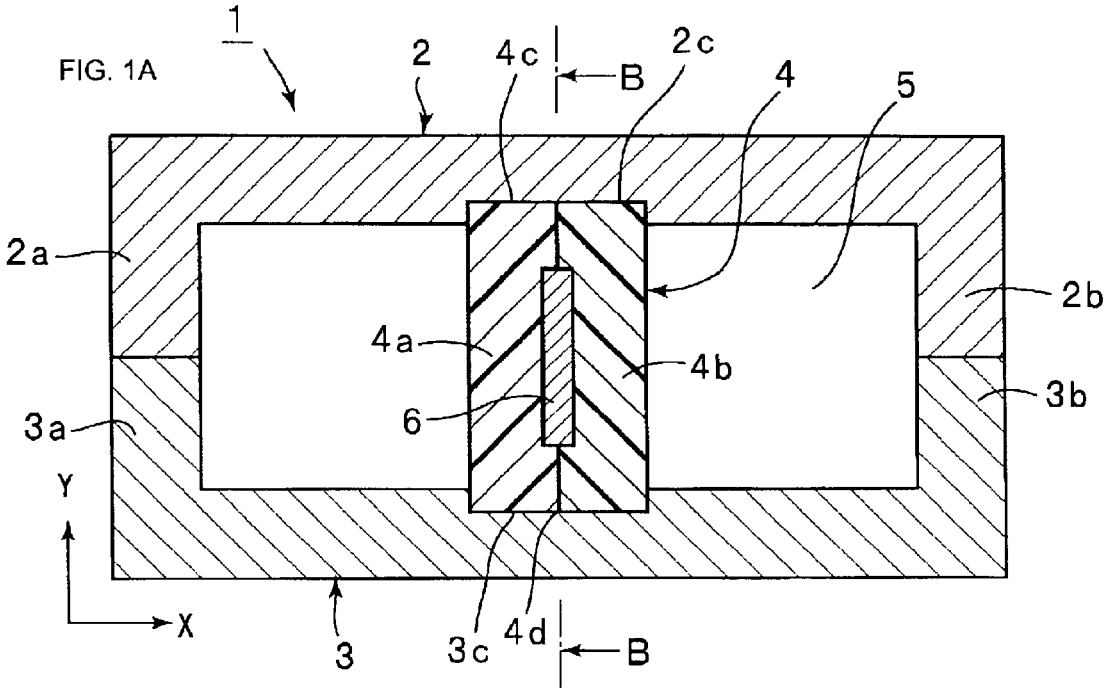
FIG. 1A is a cross sectional view of a transmission line according to a first embodiment of the present invention.
Figure 1B:
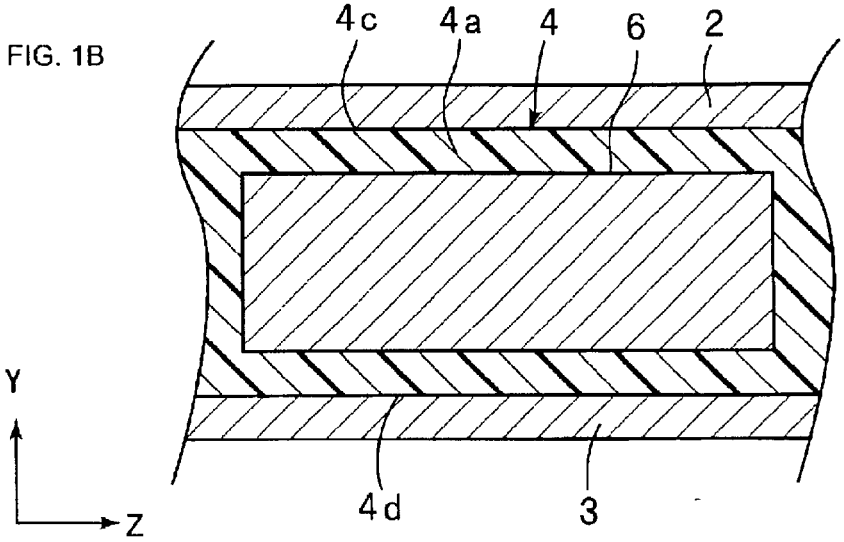
FIG. 1B is a partial cutaway side sectional view thereof, taken along a line B—B in FIG. 1A.

FIG. 1A is a cross sectional view of a high-frequency transmission line according to a first embodiment of the present invention, and FIG. 1B is a partial cutaway side sectional view of the high-frequency transmission line.

The high-frequency transmission line 1 according to the first embodiment has a dielectric line structure for transmission of the $LSM_{01}$ mode, including a resistive film to be described later. In FIG. 1A, the direction of transmission is into/out of the sheet.

More specifically, a dielectric strip 4 is disposed in a region surrounded by an upper conductor plate 2 and a lower conductor plate 3. The upper conductor plate 2 has protrusions 2*a* and 2*b*, protruding downwards, at the respective ends thereof in the width direction. The lower conductor plate 3 has protrusions 3*a* and 3*b*, protruding upwards, at the respective ends thereof in the width direction. The protrusions 2*a* and 2*b* and the protrusions 3*a* and 3*b* are joined to form a space 5. However, the protrusions 2*a*, 2*b*, 3*a*, and 3*b* are not necessarily required.

The upper conductor plate 2 and the lower conductor plate 3 may be formed of a conductive material or a composite conductive material including a dielectric material and a conductive layer covering a surface of the dielectric material. The conductive material is typically a metal, preferably having a high conductivity and good workability, such as aluminum. Also, a die-castable metal such as zinc or aluminum may be used. The dielectric material of the composite conductive material is, for example, a synthetic resin plate, and the conductive layer covering the dielectric material is formed, for example, of aluminum or gold.

The upper conductor plate 2 preferably has a groove 2*c* at a central part of a lower surface thereof, and the lower conductor plate 3 preferably has a groove 3*c* at a central part of an upper surface thereof. The dielectric strip 4 is disposed so as engage with the grooves 2*c* and 3*c*.

The dielectric strip 4 includes strip segments 4*a* and 4*b* bonded via a resistive film 6 therebetween. The strip segments 4*a* and 4*b* may be formed of any suitable dielectric material. For example, a fluorocarbon resin having favorable high-frequency characteristics, such as polytetrafluoroethylene (PTFE), may be used suitably. As an alternative to PTFE, a fluorocarbon resin that allows injection molding, such as a polytetrafluoroethylene-perfluoroalkoxyethylene (PFA) copolymer, may also be used suitably.

FIG. 1B is a partial cutaway side sectional view taken along a line B—B in FIG. 1A. Referring to FIG. 1B, the dielectric strip 4 extends in the direction in which the transmission line 1 extends, i.e., in the Z direction in which the $LSM_{01}$ mode is transmitted. The resistive film 6 is disposed in a plane that includes the Z direction, i.e., the direction of transmission of the $LSM_{01}$ mode. That is, the resistive film 6 is disposed in a plane that is substantially perpendicular to an electric field associated with the $LSM_{01}$ mode, which is the operating transmission mode. More than one resistive film 6 may be disposed in the Z direction to suppress the $LSE_{01}$ mode more effectively as will be described later.

Figure 2:
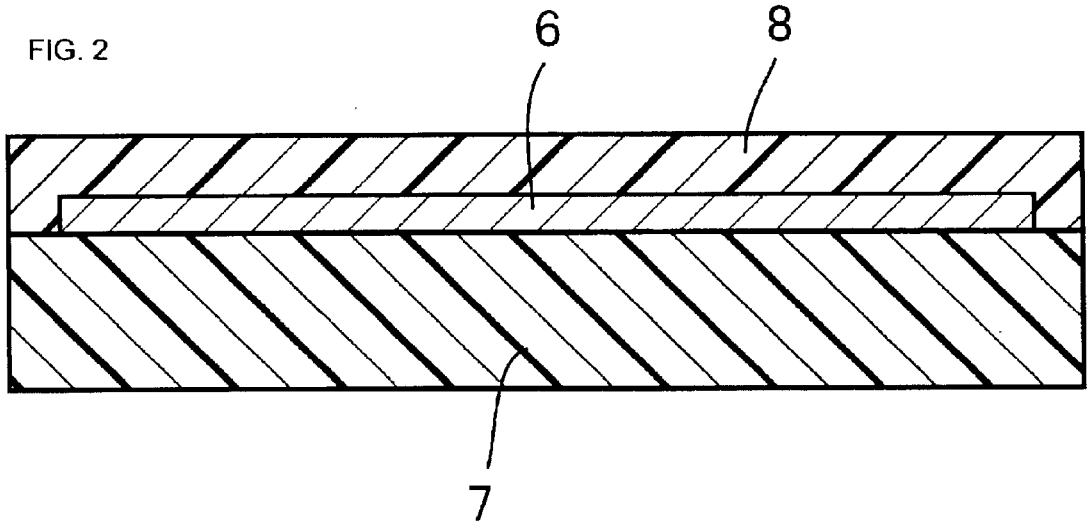
FIG. 2 is a cross sectional view showing a structure in which a resistive film is supported by a-resistive film supporting base.

Preferably, the resistive film 6 is formed of a metal having a relatively high resistivity, such as nickel-chromium. However, without limitation to metals, the resistive film 6 may be formed of a semiconductor material such as ITO (indium tin oxide). The resistive film 6 may be directly disposed in the dielectric strip 4, as shown in FIG. 1A. Alternatively, particularly if the resistive film 6 is not sufficiently thick, the resistive film 6 may be formed on a resistive-film supporting base 7, as shown in a cross sectional view in FIG. 2. This facilitates handling of the resistive film 6 since the resistive film 6 is lined by the resistive-film supporting base 7. In the example shown in FIG. 2, a protective layer 8 is formed so as to cover and thereby protect the resistive film 6.

Preferably, the resistive-film supporting base is formed of a resin sheet having a thickness on the order of 0.1 to 0.3 mm. The resin sheet is formed of, for example, a polyester resin such as polyethylene terephthalate, or polyphenylene sulfide (PPS) having favorable environment resistance.

The protective layer 8 is formed typically of a thin resin film having a thickness on the order of 1 to 10 $\mu$m.

Handling of the resistive film 6 can be facilitated easily by using the resistive-film supporting base 7. Alternatively, the resistive film 6 may be formed directly on the bonding surface of the strip segment 4*a* or the strip segment 4*b* constituting the dielectric strip 4 shown in FIG. 1A.

The resistive film supporting base 7 is shown as embedded in the dielectric strip 4 in FIGS. 1A and 1B. Alternatively, the resistive film 6 may be formed so as to extend from an upper surface 4*c* to a lower surface 4*d* of the dielectric strip 4.

Next, the principle of operation of the high-frequency transmission line according to this embodiment will be described.

When an electric field penetrates the resistive film 6, a current is generated in the resistive film 6, and power associated with the current is consumed, causing a loss. Thus, the loss increases as the magnitude of the electric field penetrating the resistive film 6 becomes larger.

As shown in FIG. 1A, the direction that is parallel to the upper and lower conductor plates 2 and 3 and that is perpendicular to the direction of transmission Z is designated as an X axis, and the direction that is perpendicular to the upper and lower conductor plates 2 and 3 is designated as an Y axis. As described earlier, the $LSM_{01}$ mode is the operating mode and the $LSE_{01}$ mode is an unwanted mode.

When the resistive film 6 is disposed in a plane that is substantially perpendicular to an electric field associated with the operating mode, i.e., the $LSM_{01}$ mode, the X-axis component becomes dominant at the location of the resistive film 6 in the electric field associated with the $LSM_{01}$ mode. On the other hand, the Y component and the Z-axis component become dominant in an electric field associated with the $LSE_{01}$ mode.

Since the magnitude of the electric field associated with the $LSE_{01}$ mode and penetrating the resistive film 6 is large, a large loss is caused. On the other hand, the magnitude of the electric field associated with the $LSM_{01}$ mode and penetrating the resistive film 6 is small, causing little loss.

The table below shows Q factors in the $LSM_{01}$ and $LSE_{01}$ modes that were calculated by two-dimensional FEM. The simulation was performed using, as the resistive film 6, a nickel-chromium film having a surface resistivity of 300 $\Omega/mm^2$ formed on a PPS film having a thickness of 0.1 mm. The table demonstrates that the use of the resistive film 6 relatively reduces the Q factor of the $LSE_{01}$ mode considerably, thus achieving the advantages described above.

Q factors of $LSM_{01}$ and $LSE_{01}$ modes with and without resistive film

| | Resistive film not used | | Resistive film used | |
|---|---|---|---|---|
| | $LSM_{01}$ | $LSE_{01}$ | $LSM_{01}$ | $LSE_{01}$ |
| Q0 | 1,482 | 1,336 | 820 | 4 |

Figure 3:
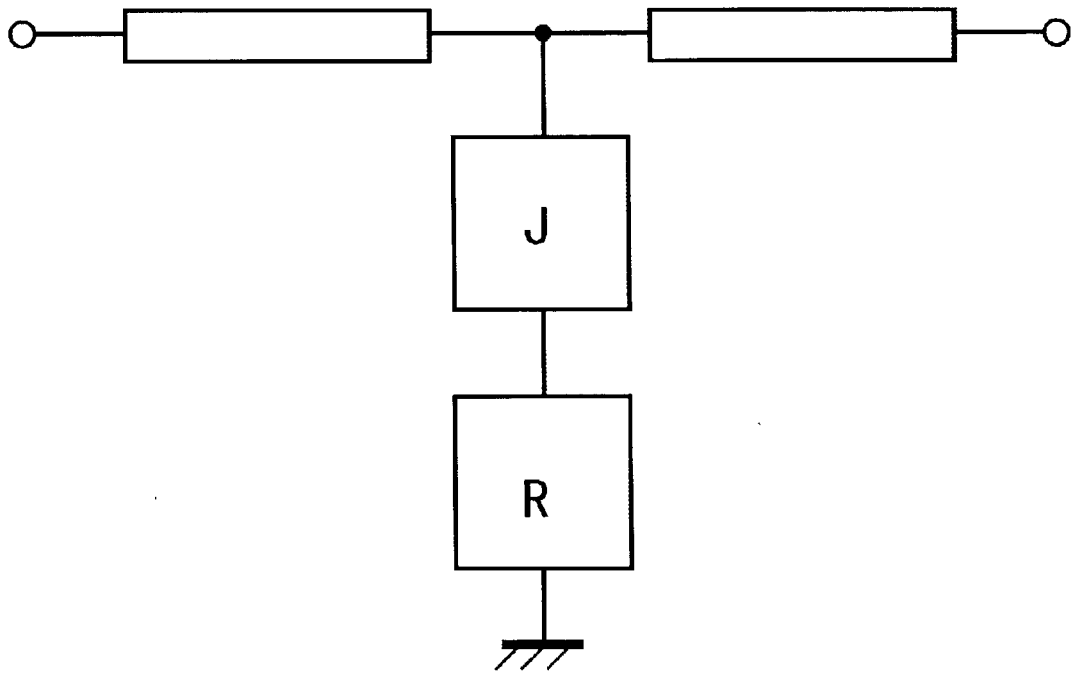
FIG. 3 is an equivalent circuit diagram for explaining loss caused by an unwanted mode in the embodiment of the present invention.
Figure 4:
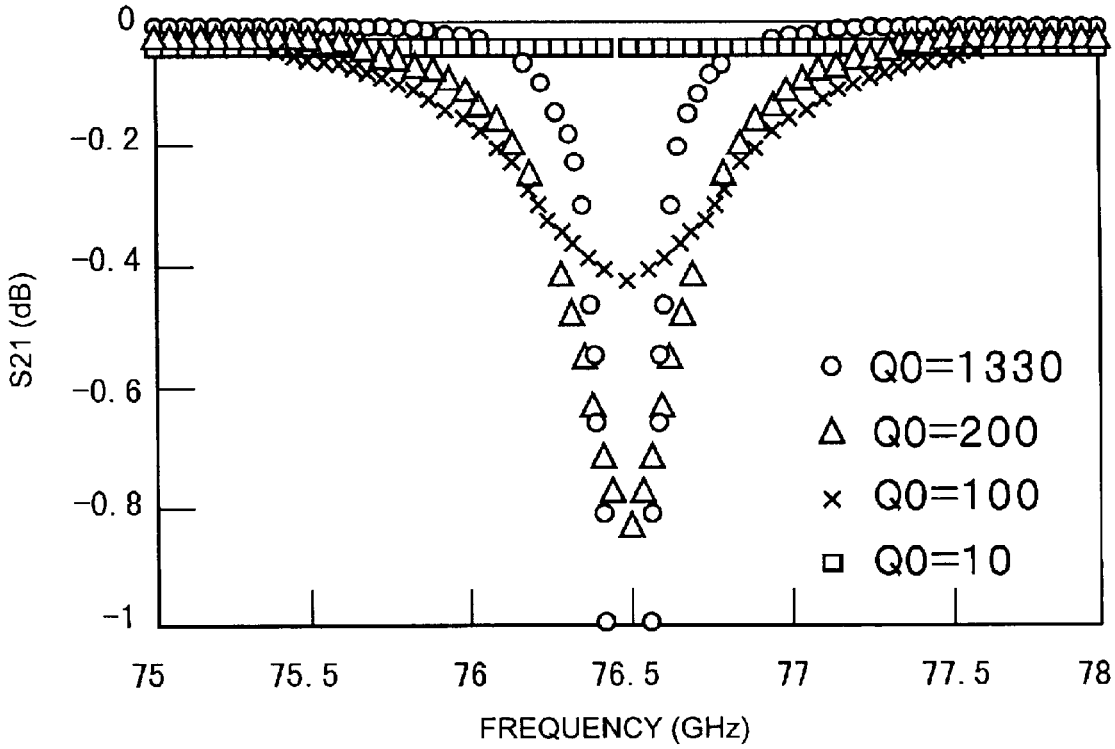
FIG. 4 is a graph showing a relationship between the Q0 factor of the $LSE_{01}$ mode and transmission loss.

Transmission loss caused by coupling of energy from the operating transmission mode to the unwanted mode and the resultant resonance of the unwanted mode can be explained based on an equivalent circuit shown in FIG. 3. FIG. 3 is a diagram showing a circuit in which an anti-resonator R of the $LSE_{01}$ mode is attached to a transmission system of the $LSM_{01}$ mode. FIG. 4 shows transmission characteristics calculated with the circuit constant of a coupling circuit J fixed and the Q0 factor of the anti-resonator R of the $LSE_{01}$ mode varied.

As is apparent from FIG. 4, the transmission loss is reduced as the Q0 factor of the anti-resonator R of the $LSE_{01}$ mode is decreased.

Accordingly, it is understood that, as described earlier, the use of the resistive film 6 relatively reduces the Q0 factor of the unwanted $LSE_{01}$ mode considerably, inhibiting the coupling of energy from the operating $LSM_{01}$ mode to the unwanted $LSE_{01}$ mode, thereby suppressing the $LSE_{01}$ mode.

Figure 5:
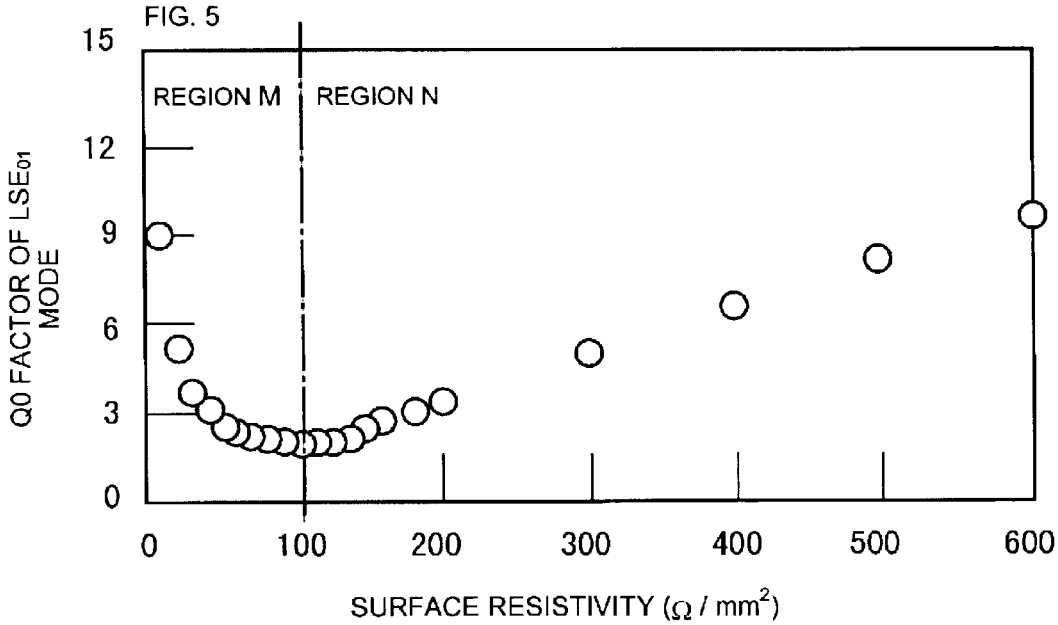
FIG. 5 is a graph showing a relationship between the surface resistivity of the resistive film and the Q factor of the $LSE_{01}$ mode.

The inventors examined the effects of change in the surface resistivity of the resistive film 6. FIG. 5 shows a relationship between the surface resistivity of the resistive film 6 and the Q0 factor of the unwanted $LSE_{01}$ mode, obtained by two-dimensional FEM analysis. As is apparent from FIG. 5, the Q0 factor was minimized when the surface resistivity of the resistive film 6 was in the vicinity of 100 $\Omega/mm^2$. Accordingly, the Q0 factor of the $LSE_{01}$ mode can be efficiently reduced by choosing a surface resistivity in the vicinity of the surface resistivity associated with the minimum Q0 factor.

Figure 6A:
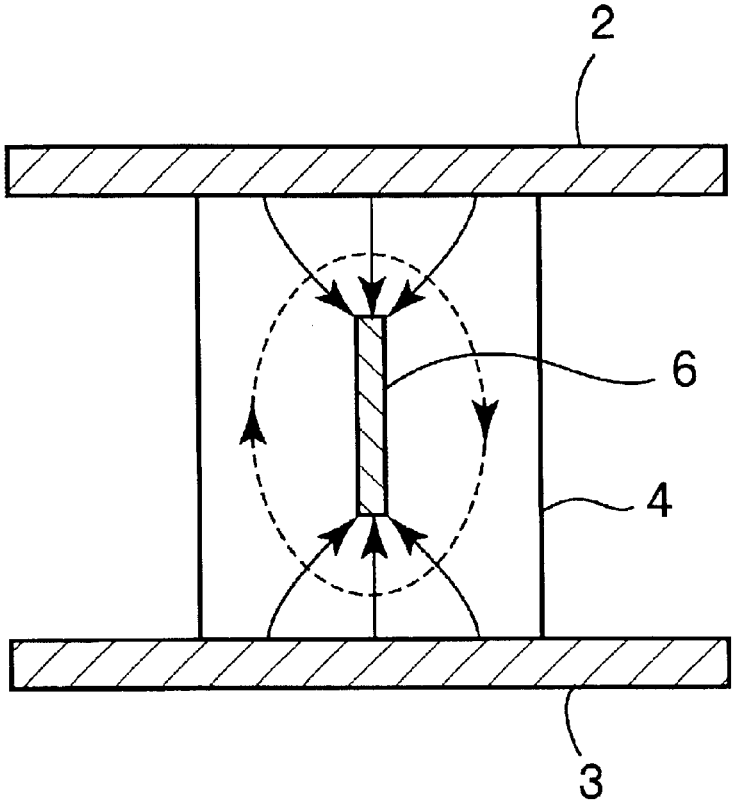
FIGS. 6A and 6B are diagram showing electromagnetic field vectors in cases where the surface resistivity is small and large, respectively.
Figure 6B:
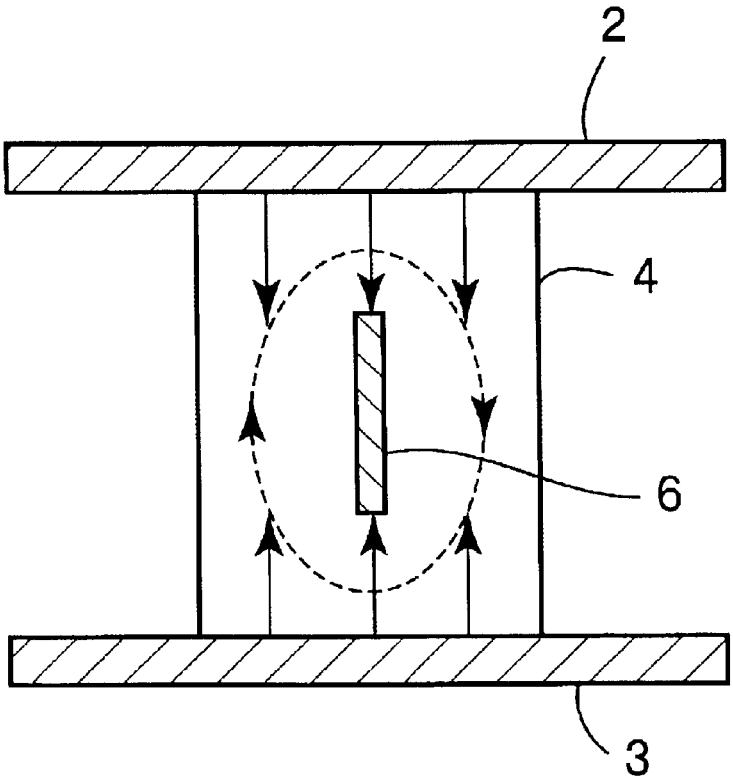

In FIG. 5, a region associated with the lower-resistivity side of the point of the minimum Q0 factor is denoted as a region M and a region associated with the higher-resistivity side thereof is denoted as a region N. FIGS. 6A and 6B show electromagnetic field vectors of the $LSE_{01}$ mode in the regions M and N, respectively, obtained by two-dimensional FEM analysis. In FIGS. 6A and 6B, solid arrows indicate electric field vectors while dashed arrows indicate magnetic field vectors.

As shown in FIG. 6B, in the region N, the electric field vectors are not disturbed even if the resistive film 6 is used. In the region M, however, the electric field vectors are directed toward the resistive film 6, as shown in FIG. 6A. This is presumed to occur due to the resistive film 6 acting like a metal because of the low resistivity of the resistive film 6 in the region M.

On the other hand, in the region N, the resistivity of the resistive film 6 is high, so that the resistive film 6 acts as a dielectric member. Accordingly, it is understood that the electric vectors are not disturbed.

When the resistive film 6 acts like a metal as described earlier, the TEM mode, which is also unwanted, could be generated, similarly to the case of the mode suppressor according to the related art. Thus, preferably, the surface resistivity of the resistive film 6 is greater than or equal to 100 $\Omega/mm^2$. Furthermore, the inventors verified by experiments that, although the surface resistivity that minimizes the Q factor of the $LSE_{01}$ mode slightly varied depending on design specifications such as a sectional shape of an NRD guide, in any case, the resistive film 6 acted as a dielectric member if the surface resistivity is greater than or equal to 150 $\Omega/mm^2$. Thus, more preferably, the surface resistivity of the resistive film 6 is greater than or equal to 150 $\Omega/mm^2$. Furthermore, the surface resistivity is preferably not greater than 1,000 $\Omega/mm^2$. This is due to the following reasons.

To express the Q factor of the $LSE_{01}$ mode in terms of transmission loss, a surface resistivity of 100 $\Omega/mm^2$, that is, a surface resistivity that minimizes the Q factor of the $LSE_{01}$ mode, corresponds to a transmission loss of 9 dB/mm, and a surface resistivity of 1,000 $\Omega/mm^2$ corresponds to a transmission loss of 1.5 dB/mm. Accordingly, when the surface resistivity is increased tenfold, the transmission loss is reduces to approximately one sixth. This indicates that, when the surface resistivity is increased from 100 $\Omega/mm^2$ to 1,000 $\Omega/mm^2$, the length of the resistive film must be extended sixfold in the direction of transmission in order to suppress the unwanted mode to the same degree, which results in a larger size of the transmission line. Therefore, the surface resistivity is preferably not greater than 1,000 $\Omega/mm^2$.

The relationship among the surface resistivity $R(\Omega/mm^2)$, the conductivity $\sigma$(S/m) of the resistive film, and the thickness t (m) of the resistive film can be expressed as $R=(1/\sigma t)$. Thus, the thickness t must be reduced in order to form a resistive film with a high surface resistivity using a particular material. For example, in the case of a nickel-chromium film, since the volume resistivity of nickel-chromium at normal temperature is $1\times10^{-6}$ ($\Omega$/m), assuming that the resistivity is the same for a thin film, the thickness t of the nickel-chromium film is 10 nm in order to form a resistive film having a resistivity of 100 $\Omega/mm^2$, and the thickness t is 1 nm in order to form a resistive film having a resistivity of 1,000 $\Omega/mm^2$. It is difficult to precisely form a resistive film that is as thin as or thinner than 1 nm, resulting in increased manufacturing cost. Furthermore, a reduced thickness of the resistive film may lower environment resistance, degrading the reliability of the transmission line.

By the above reasons, the surface resistivity of the resistive film 6 is preferably in a range of 100 to 1,000 $\Omega/mm^2$.

The advantages of the high-frequency transmission line according to this embodiment will be described with reference to FIG. 8.

Figure 8:
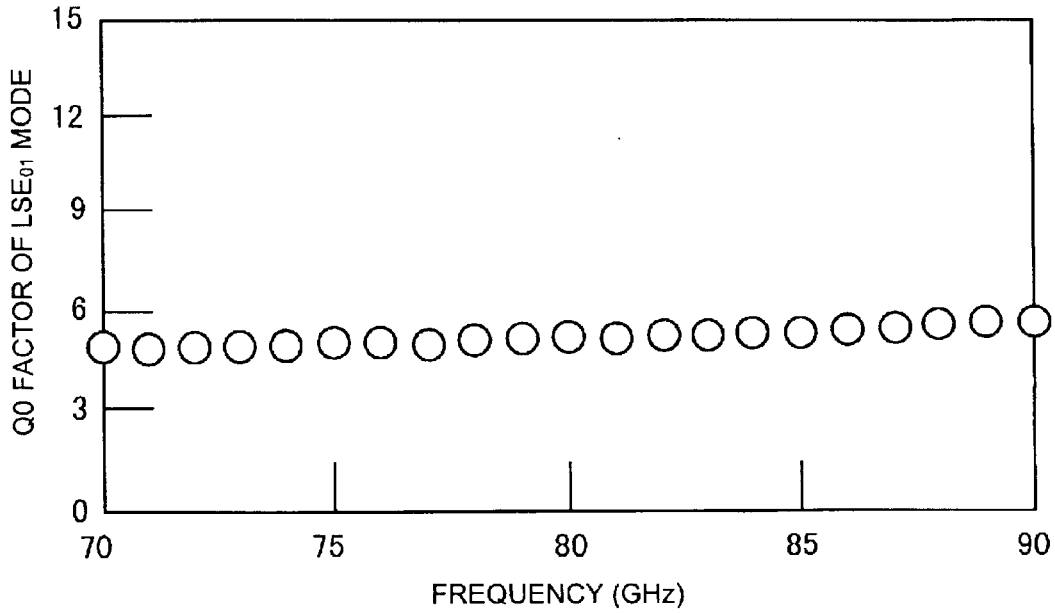
FIG. 8 is a graph showing a relationship between the Q0 factor of the $LSE_{01}$ mode and frequency in a case where the resistive film is used.

FIG. 8 shows frequency characteristics of the unwanted $LSE_{01}$ mode in the millimeter wave band in the high-frequency transmission line according to this embodiment. The frequency characteristics relate to the Q0 factor of the $LSE_{01}$ mode in a case where the surface resistivity of the resistive film 6 is 300 $\Omega/mm^2$. The Q0 factor is obtained by two-dimensional FEM analysis.

As is apparent from FIG. 8, variation of the Q0 factor in relation to the frequency is small, that is, the unwanted mode is suppressed in a wide range of band.

A high-frequency transmission line according to the present invention may be applied to various dielectric line structures. As a second embodiment of the present invention, an example in which a high-frequency transmission line according to the present invention is applied to a dielectric line coupler will be described.

Figure 9:
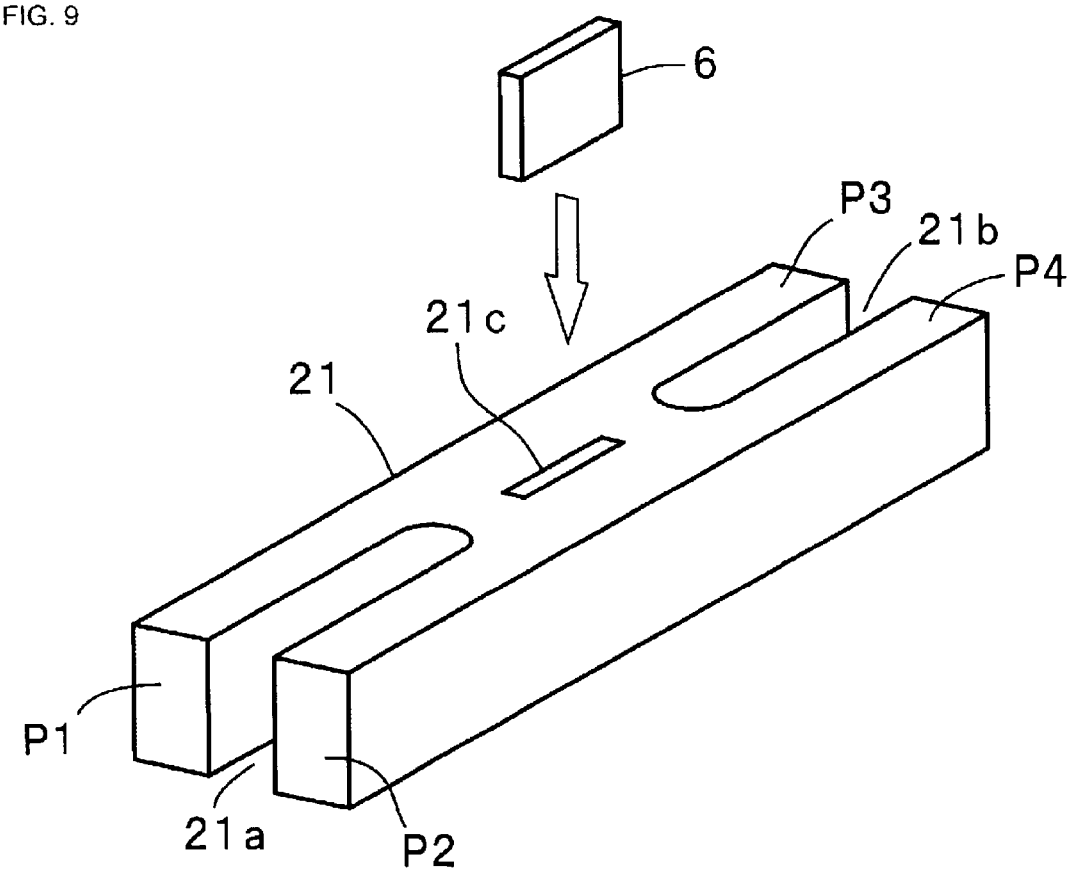
FIG. 9 is an exploded perspective view showing a region where a dielectric strip and a resistive film for use in a dielectric line coupler according to a second embodiment of the present invention are disposed.
Figure 10:
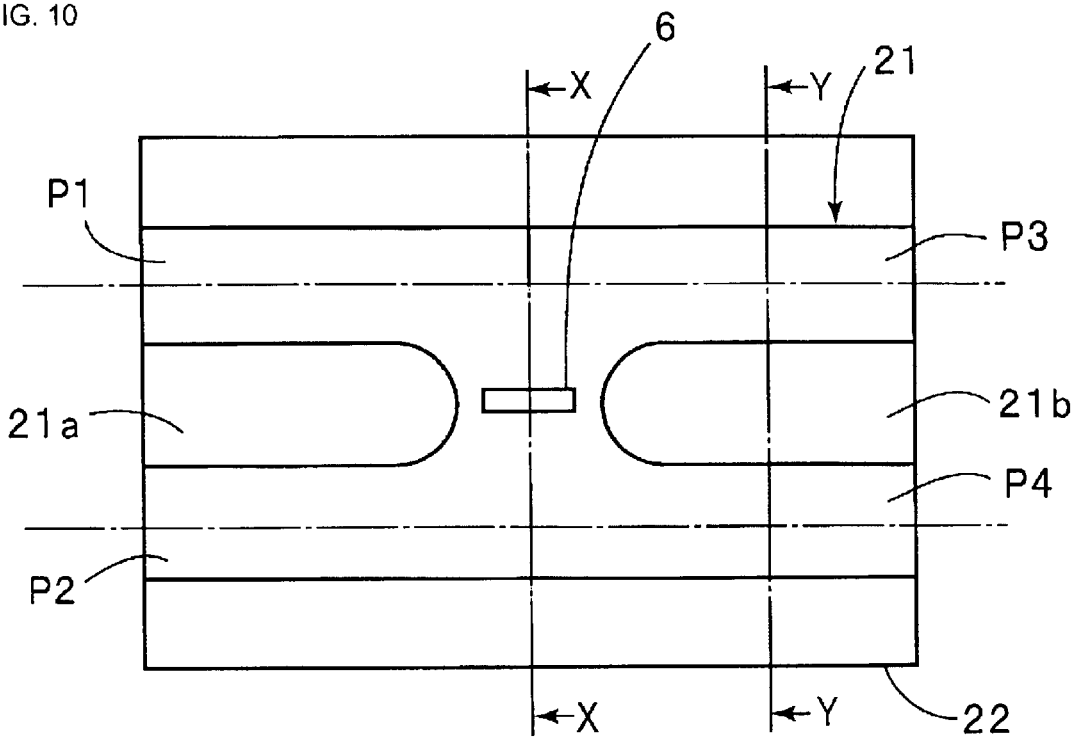
FIG. 10 is a schematic plan view of the dielectric line coupler according to the second embodiment, with an upper conductor plate removed therefrom.

FIG. 9 is a perspective view showing the construction of a dielectric strip in the dielectric line coupler according to the second embodiment. FIG. 10 is a plan view showing the dielectric line coupler with an upper conductor plate removed therefrom. As shown in FIGS. 9 and 10, a coupler 21 preferably includes a rectangular parallelepiped dielectric strip having planar or U-shaped grooves 21*a* and 21*b* extending lengthwise from the respective ends to central portions. Ports P1 and P2 are formed on the respective sides of the groove 21*a*, and ports P3 and P4 are formed on the respective sides of the groove 21*b*. For example, a signal input to the port P1 is distributed to the ports P3 and P4 by a predetermined division ratio.

In this embodiment, a penetrating hole 21*c* is formed at a region of connection between the ports P1 and P2 and the ports P3 and P4, and a resistive film 6 is disposed in the penetrating hole 21*c*.

As shown in FIG. 10, the dielectric strip is disposed on a lower conductor plate 22. Furthermore, an upper conductor plate is disposed on top of the dielectric strip. That is, the dielectric strip is sandwiched between the upper and lower conductor plates.

Known dielectric line couplers have suffered a problem that a standing wave of an unwanted mode is excited in a space of the connection region of the dielectric strip constituting the ports P1 to P4, causing transmission loss. In contrast, according to this embodiment, the use of the resistive film 6 serves to suppress propagation of an unwanted mode, similarly to the first embodiment. This will be described with reference to FIG. 11.

Figure 11:
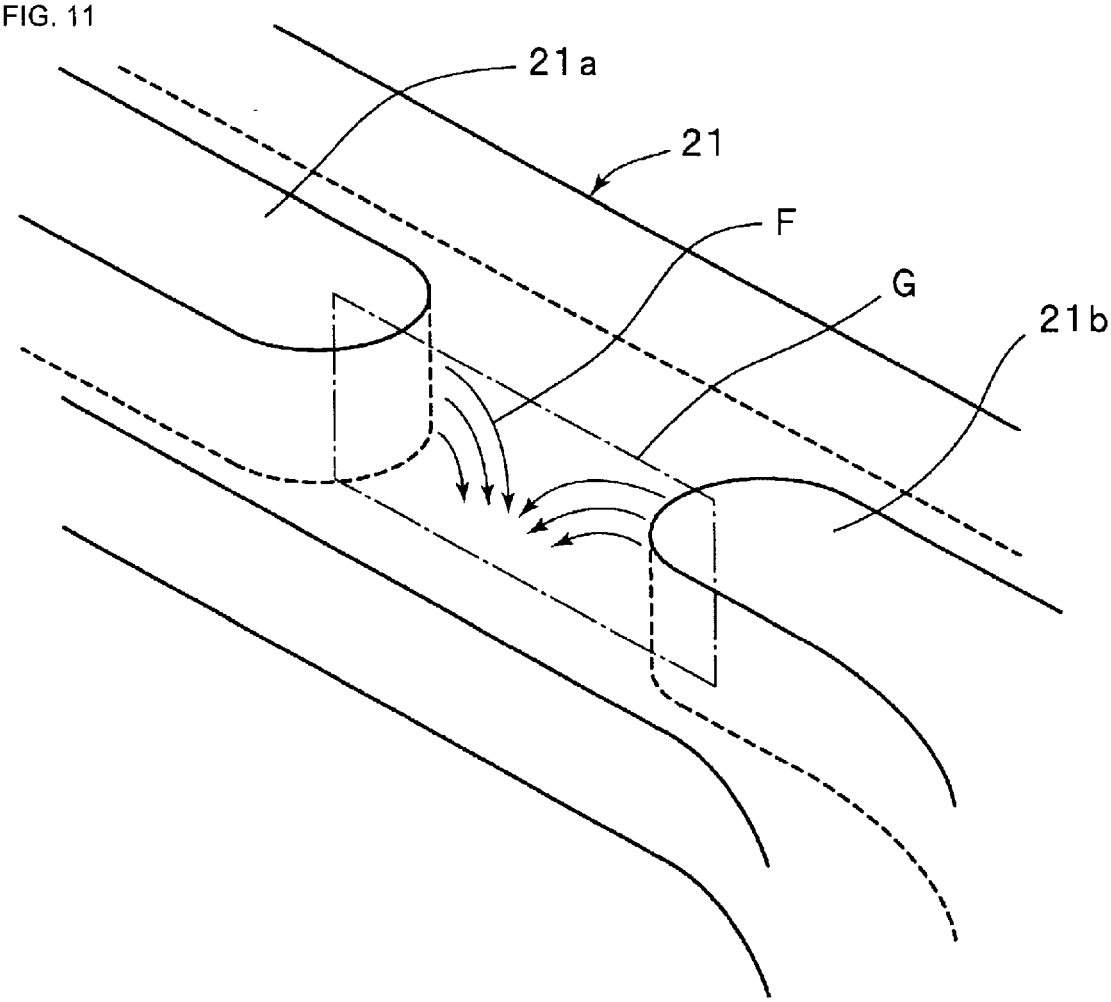
FIG. 11 is a schematic perspective view for explaining electric field vectors associated with an unwanted mode that is generated in the dielectric line coupler according to the second embodiment.

FIG. 11 schematically shows electric field vectors, indicated by arrows F, associated with an unwanted mode excited in the dielectric line coupler 21. The direction of the electric field vectors F is parallel to the direction of the plane of the resistive film 6. On the other hand, electric field vectors associated with an operating mode resides in a plane that is perpendicular to the electric field vectors associated with the unwanted mode indicated by the arrows F. Thus, by disposing the resistive film 6 in parallel to a plane G indicated by a dotted-chain line in FIG. 11 (i.e., in a plane that is perpendicular to the electric field vectors associated with the operating mode), the unwanted mode is suppressed similar to the first embodiment, thereby allowing efficient transmission of the operating mode.

Now, a 0-dB coupler, which is a high-frequency transmission line according to a third embodiment of the present invention, will be described with reference to FIGS. 12 to 14.

The 0-dB coupler includes, for example, a transition unit for structural transition from a hyper NRD guide disclosed in Japanese Patent No. 2,998,614 to a nonradiative dielectric line disclosed in Japanese Examined Patent Application Publication No. 62-35281. The hyper NRD guide can be designed so that only the $LSM_{01}$ mode will be transmitted while blocking the $LSE_{01}$ mode.

On the other hand, it is difficult to design an ordinary nonradiative dielectric line as such, and propagation of the $LSE_{01}$ mode is inevitably allowed. Thus, in the nonradiative dielectric line, a standing wave of the $LSE_{01}$ mode is excited, increasing transmission loss of the $LSM_{01}$ mode.

In this embodiment, a transmission line structure according to the present invention is also used in the 0-dB coupler for implementing the transition unit, so that transmission loss attributable to the unwanted $LSE_{01}$ mode is suppressed.

Figure 7A:
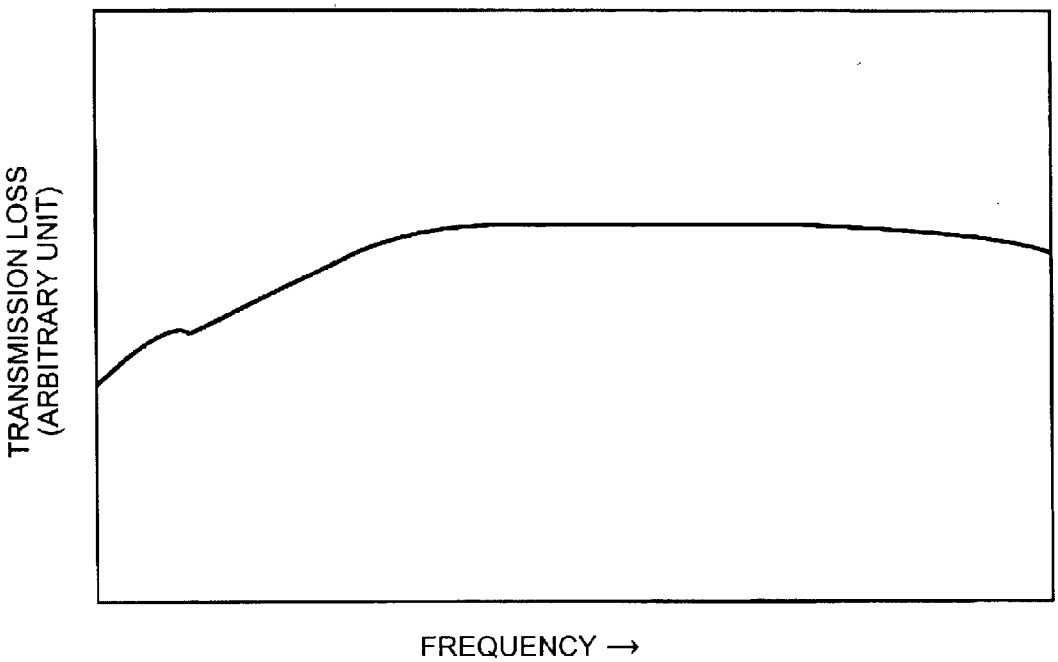
FIGS. 7A and 7B are graphs showing transmission loss-frequency characteristics of a 0-dB coupler according to the embodiment, in which the resistive film is disposed, and a 0-dB coupler in which the resistive film is not disposed, respectively.
Figure 7B:
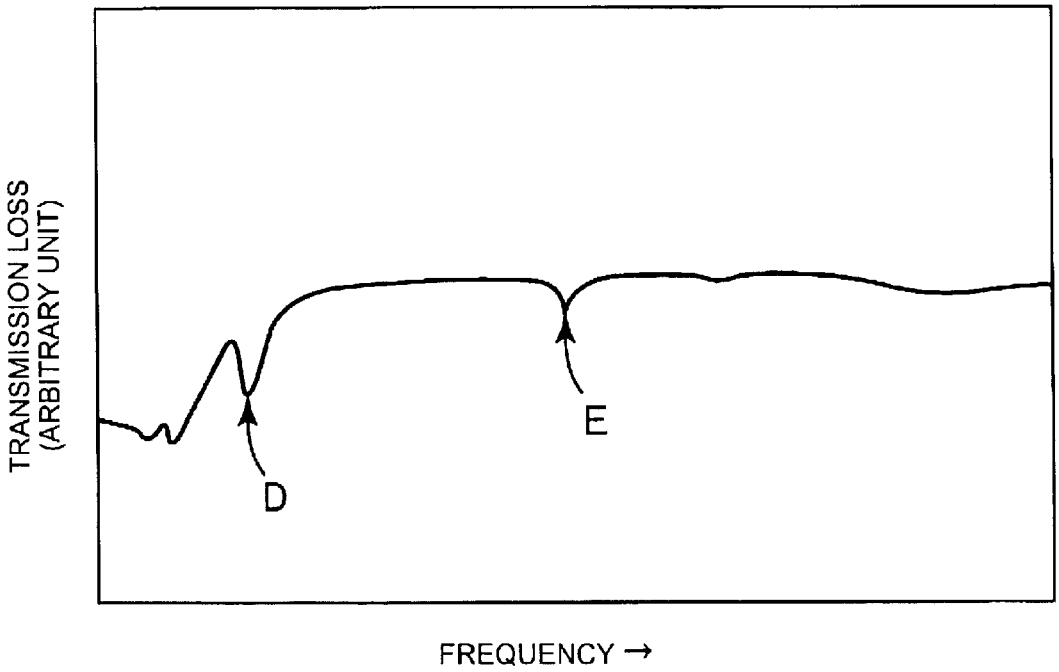

FIG. 7A shows the transmission loss-frequency characteristics of the $LSM_{01}$ mode in the high-frequency transmission line according to this embodiment, and FIG. 7B shows the transmission loss-frequency characteristics in a high-frequency transmission line that is constructed similarly to the embodiment but without the resistive film 6.

As is apparent from FIGS. 7A and 7B, loss presumably attributable to unwanted modes indicated by arrows D and E is caused in the case without the resistive film 6, while such loss is not caused in this embodiment.

In a line structure in which a standing wave is excited, when the mode suppressor described in the related art section is used, the mode suppressor must be disposed throughout the entire region where the standing wave of an unwanted mode is excited. In contrast, according to this embodiment, in which a resistive film is disposed, it is sufficient to dispose the resistive film in a part of the region where the standing wave of the unwanted mode is excited. This is because the Q0 factor of the $LSE_{01}$ mode is considerably suppressed by the resistive film and the Q0 factor of the $LSE_{01}$ mode in the entire region where the standing wave is excited is efficiently lowered. Thus, the $LSE_{01}$ mode component is sufficiently suppressed by disposing the resistive film only in a part of the region where the standing wave is excited.

If the length of the resistive film 6 along the direction of transmission is greater than or equal to one half of the wavelength $\lambda g$ within the tube of the $LSE_{01}$ mode, the effect of variation in the position of the resistive film is alleviated. When a standing wave is excited, the electric field is distributed within the region of excitation. However, by using the resistive film 6 having a length greater than or equal to one half the wavelength of the $LSE_{01}$ mode, a constant effect is achieved regardless of the position of the resistive film 6.

Figure 12:
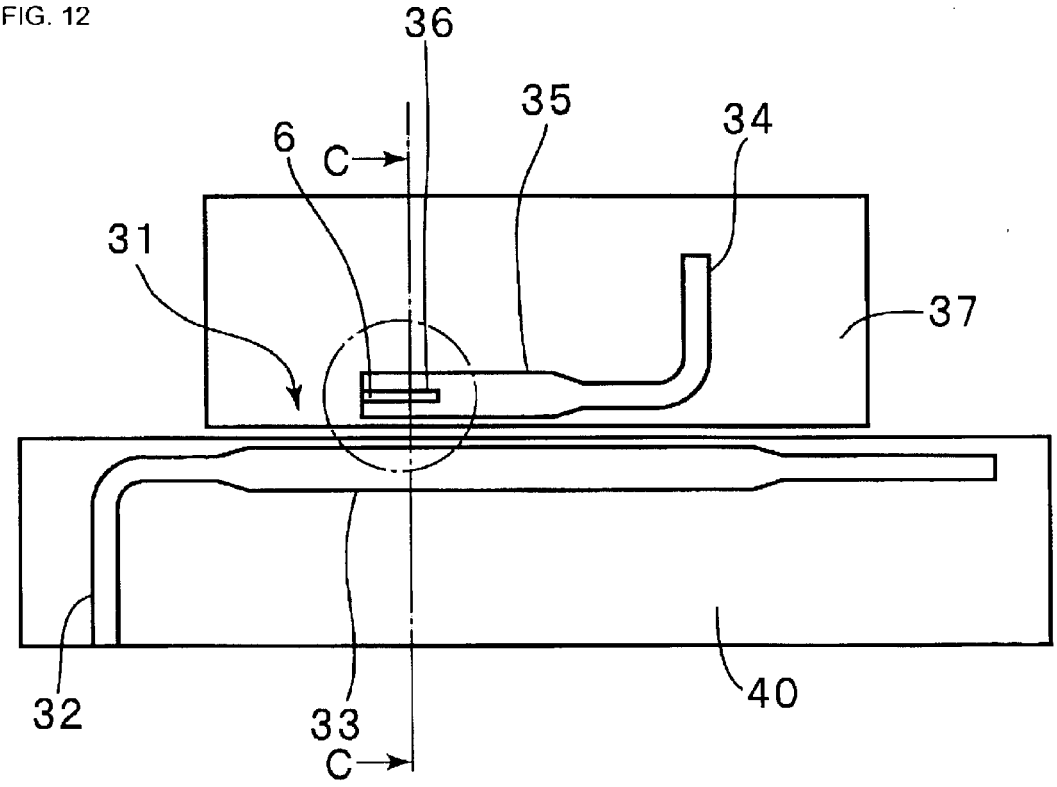
FIG. 12 is a plan view showing a 0-dB coupler according to a third embodiment of the present invention, with an upper conductor plate removed therefrom.
Figure 13:
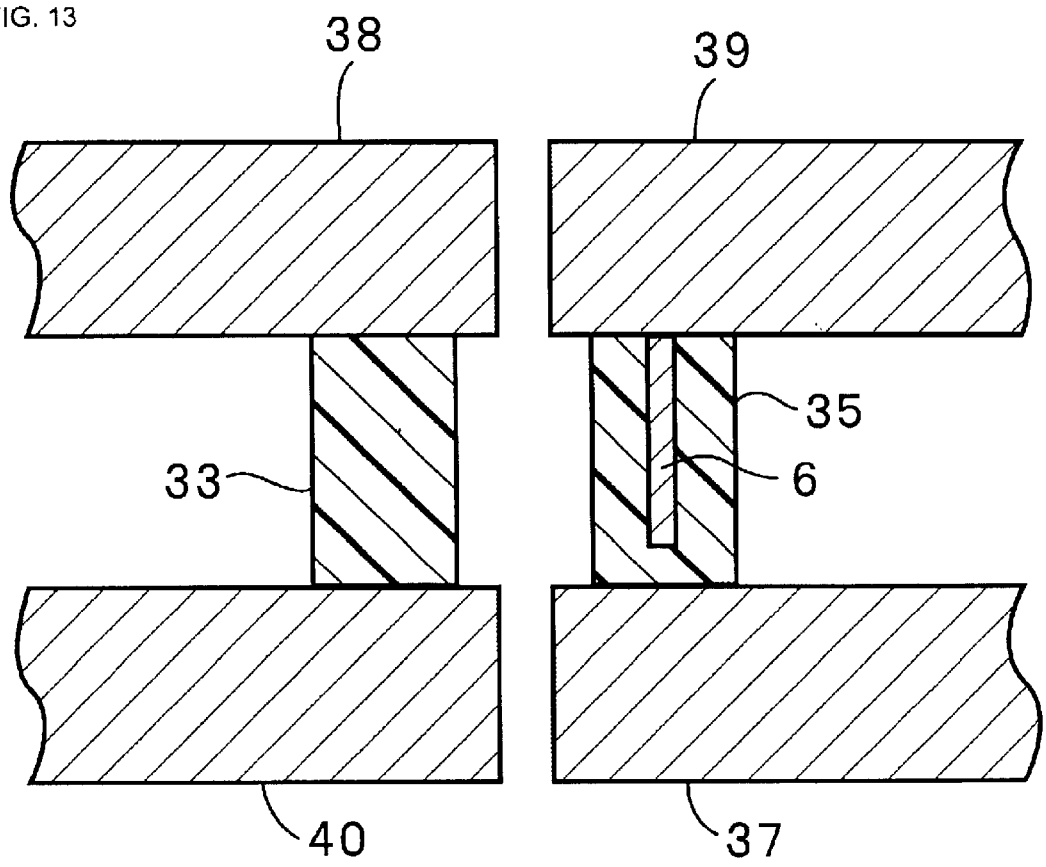
FIG. 13 is a partial cutaway sectional view taken along a line C—C in FIG. 12.

As shown in FIGS. 12 and 13, a 0-dB coupler 31 includes a nonradiative dielectric line 33 linked to a hyper NRD guide 32. Furthermore, a dielectric strip 35 linked to a primary radiator 34 is disposed in parallel to the nonradiative dielectric line 33, and the resistive film 6 is disposed in a penetrating hole 36 provided in the dielectric strip 35. The penetrating hole 36 extends in parallel to the nonradiative dielectric line 33, and thus the resistive film 6 is disposed in a plane that is perpendicular to electric field vectors associated with the $LSE_{01}$ mode.

40 and 37 denote lower conductor plates and 38 and 39 denote upper conductor plates. In FIG. 12, shows a state where the upper conductor plates 38 and 39 are removed.

Figure 14:
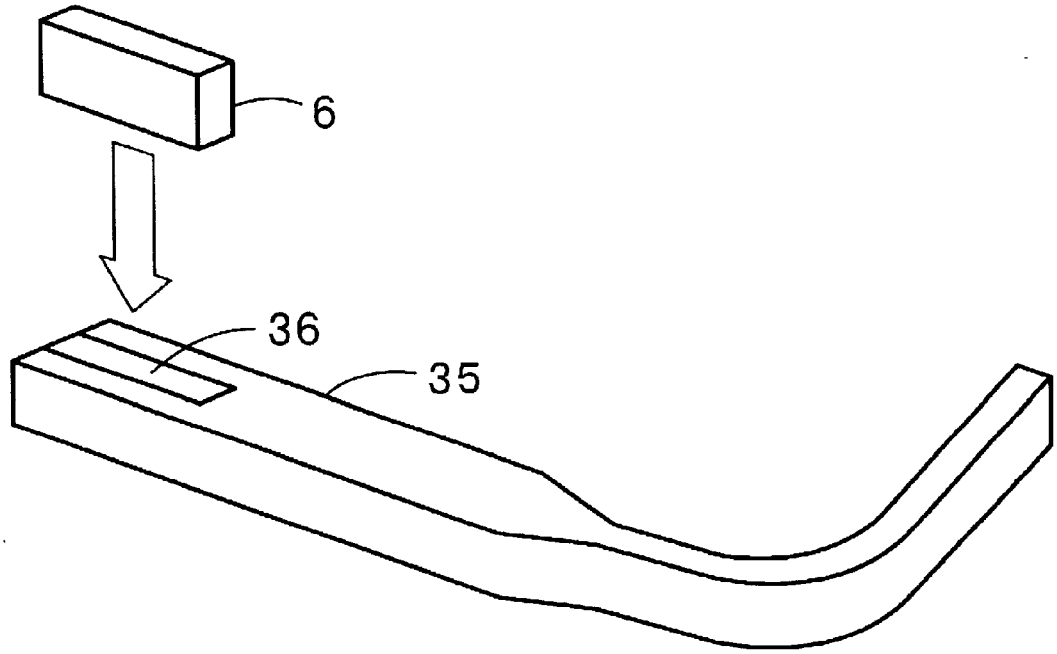
FIG. 14 is an exploded perspective view showing main parts of the 0-dB coupler according to the third embodiment.

Also in this embodiment, by using a supporting base that supports the resistive film 6 as described in relation to the first embodiment, the resistive film 6 can be readily disposed in the penetrating hole 36 of the dielectric strip 35, as shown in FIG. 14.

According to the present invention, when the thickness of the resistive film is increased, the Q factor of the operating $LSM_{01}$ mode could be degraded as well as the Q factor of the unwanted mode being suppressed. Thus, the thickness of the resistive film is preferably smaller than the skin depth of a current in the operating frequency range. More preferably, the thickness t of the resistive film 6 in a direction that is perpendicular to the electric fields associated with the operating transmission mode and the skin depth $\delta$ of a current in the operating frequency range satisfy the relationship $t/\delta \leqq 0.1$. This will be described with reference to FIGS. 15 to 17.

Figure 15:
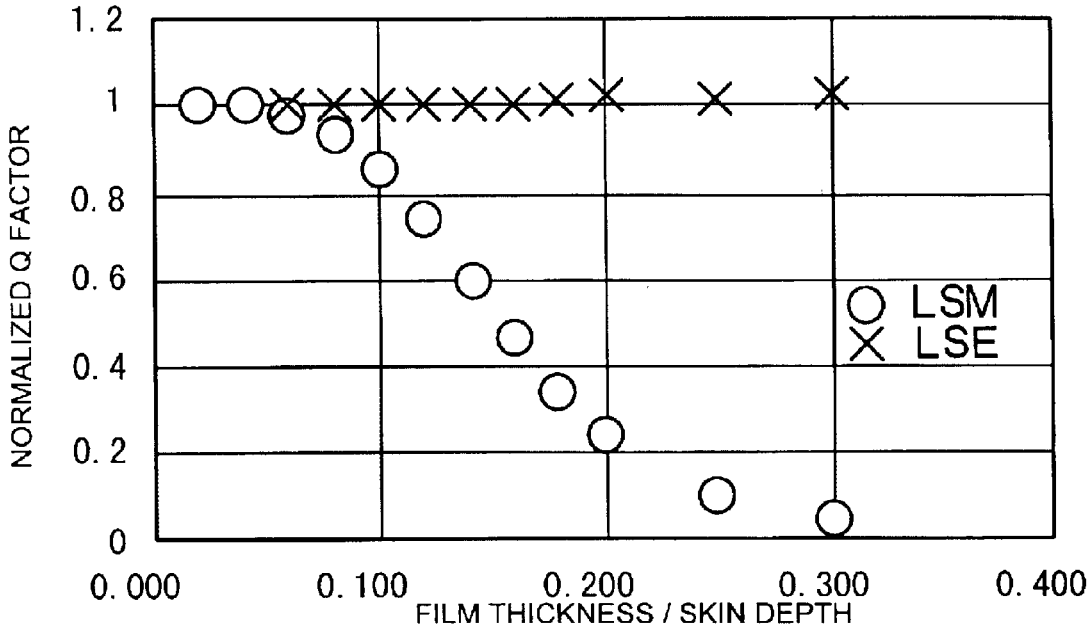
FIG. 15 is a graph showing a relationship between the thickness t of a resistive film/the skin depth δ and the normalized Q factors of the $LSM_{01}$ mode and $LSE_{01}$ mode in a case where the operating frequency is 50 GHz.
Figure 16:
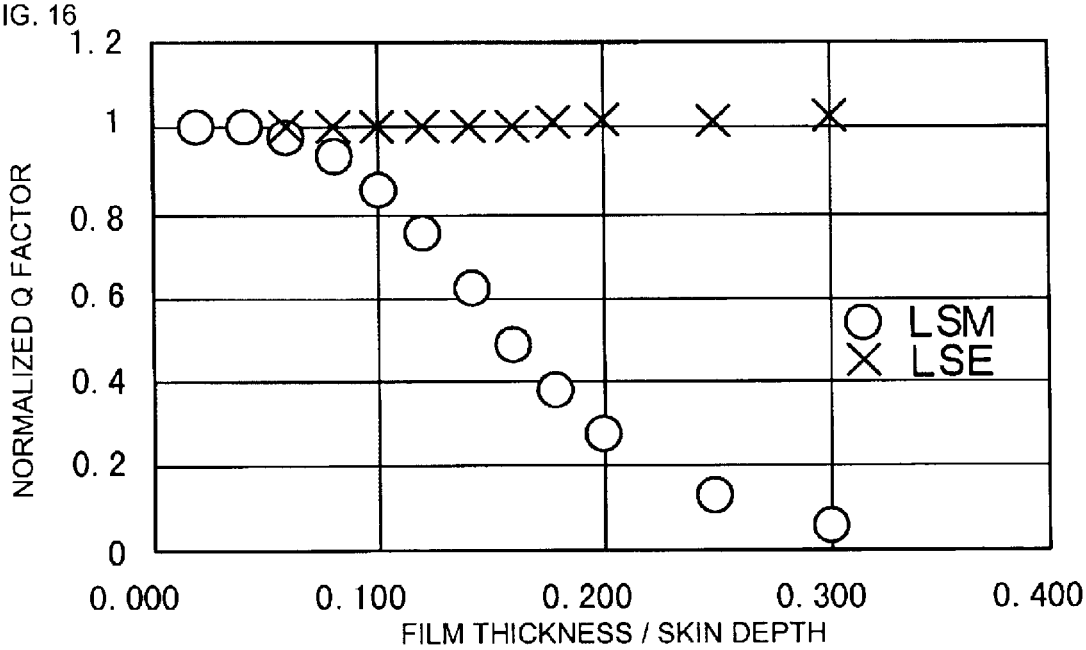
FIG. 16 is a graph showing a relationship between the thickness t of a resistive film/the skin depth δ and the normalized Q factors of the $LSM_{01}$ mode and $LSE_{01}$ mode in a case where the operating frequency is 76 GHz.
Figure 17:
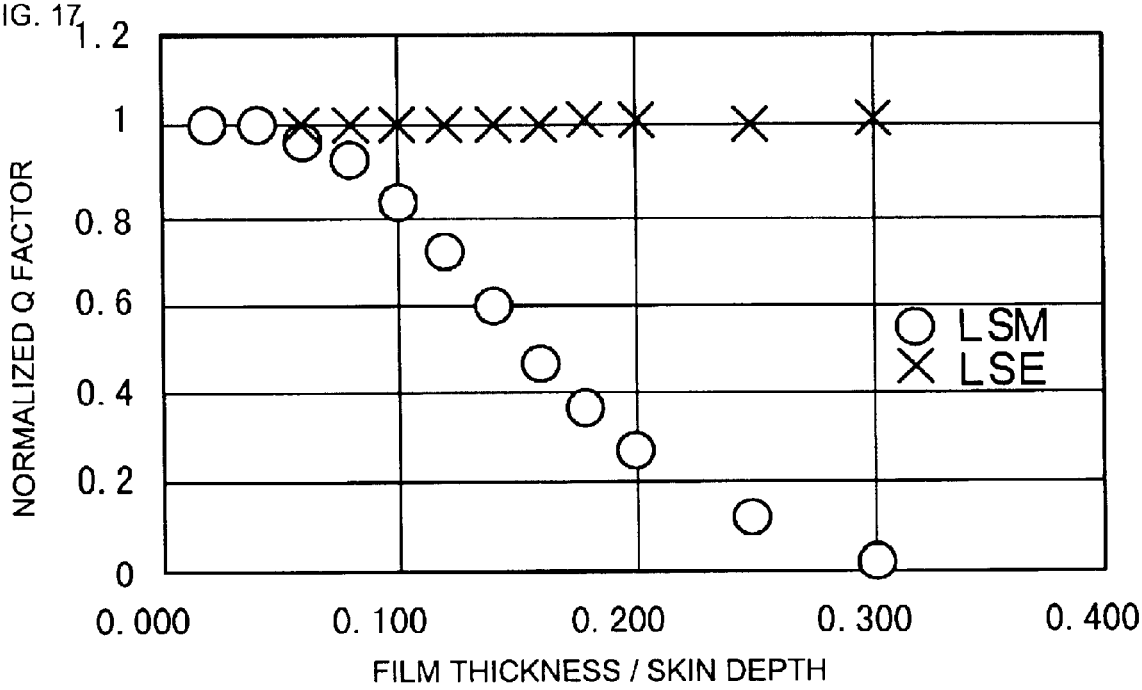
FIG. 17 is a graph showing a relationship between the thickness t of a resistive film/the skin depth δ and the normalized Q factors of the $LSM_{01}$ mode and $LSE_{01}$ mode in a case where the operating frequency is 110 GHz.

FIGS. 15 to 17 show relationships between the Q factors in the $LSE_{01}$ and $LSM_{01}$ modes and the thickness of the resistive film t/the skin depth $\delta$ at frequencies of 50 GHz, 76 GHz, and 110 GHz, respectively. The Q factors are normalized to that in the case of $t/\delta=0.02$. The skin depth $\delta$ (m) is that in a case where a plane wave in the free space, having an angular frequency $\omega$, is incident vertically upon a uniform conductor having a conductivity $\sigma$(S/m) and a permeability $\mu$, and is expressed as:

$$\delta=(2/\omega\cdot\mu\sigma)^{1/2}$$

In the results shown in FIGS. 15 to 17, the surface resistivity of the resistive film 6 is assumed to be 300 $\Omega/mm^2$. The relationship among the thickness t (m), the conductivity $\sigma$, and the surface resistivity $R(\Omega/mm^2)$ can be expressed as $R=1/(\sigma\cdot t)$.

Thus, it is understood from FIGS. 15 to 17 that, when the value of $t/\delta$ increases, the Q factor of the $LSE_{01}$ mode does not substantially change while the Q factor of the $LSM_{01}$ mode considerably falls when the ratio $t/\delta$ exceeds 0.1. Accordingly, transmission loss of the operating transmission mode can be suppressed by choosing a $t/\delta$ not exceeding 0.1.

Figure 18:
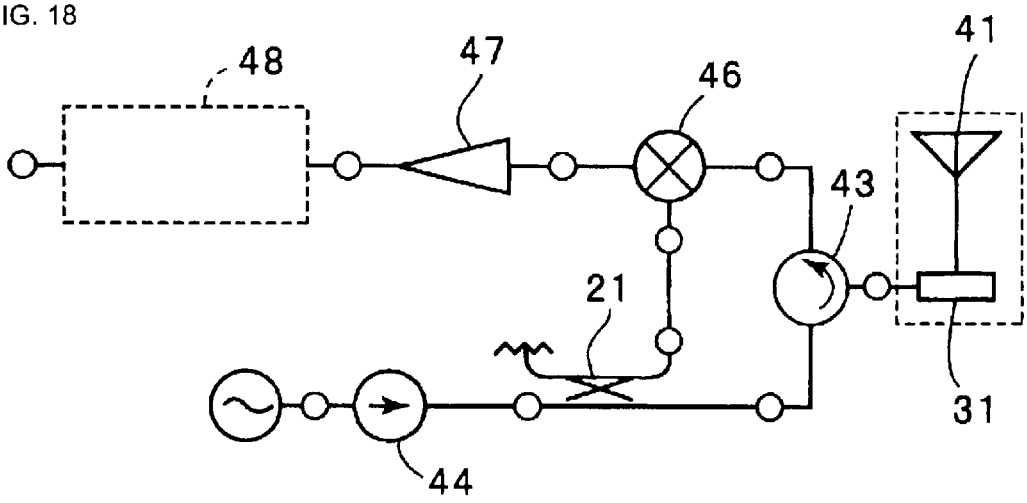
FIG. 18 is a schematic block diagram of a communication apparatus including a dielectric line coupler and a 0-dB coupler that are constructed using transmission lines according to the present invention.
Figure 19:
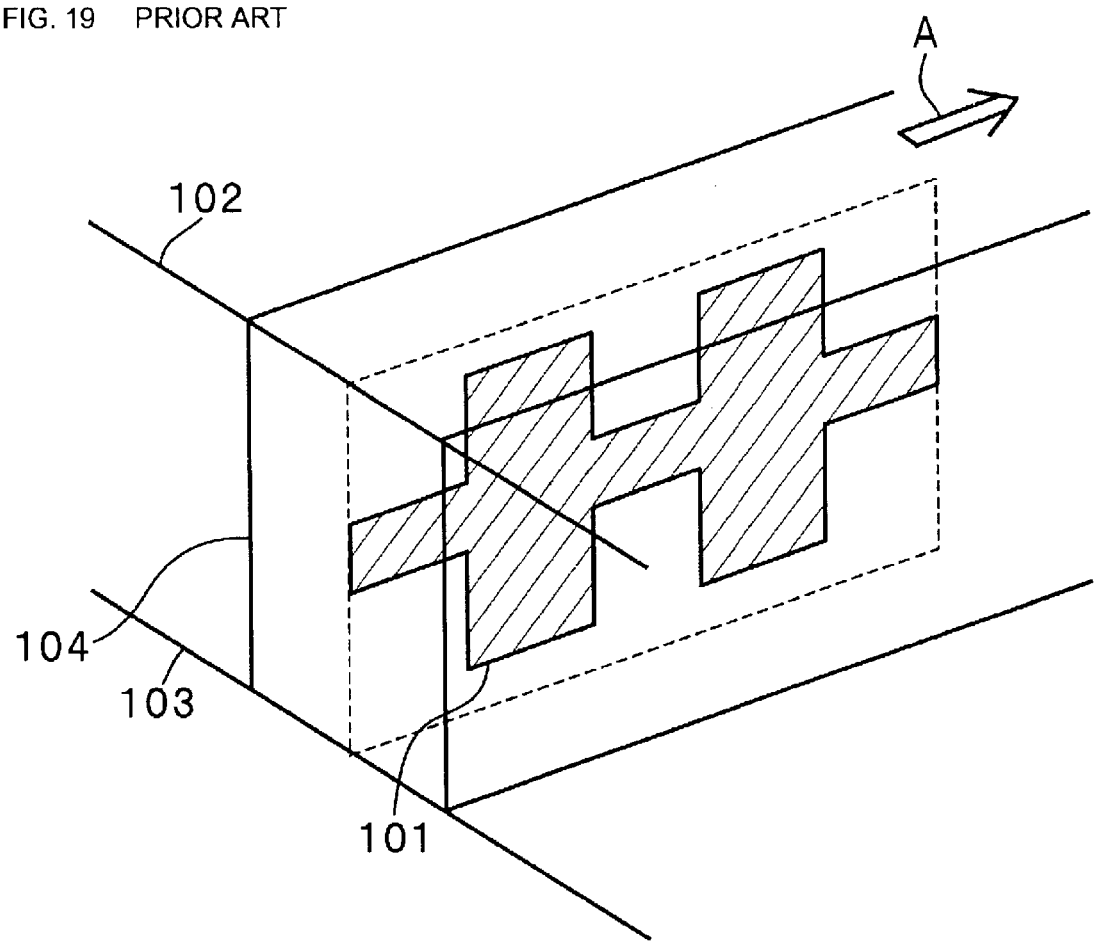
FIG. 19 PRIOR ART
FIG. 19 is a schematic perspective view showing a mode suppressor provided in a transmission line according to a related art.
Figure 20A:
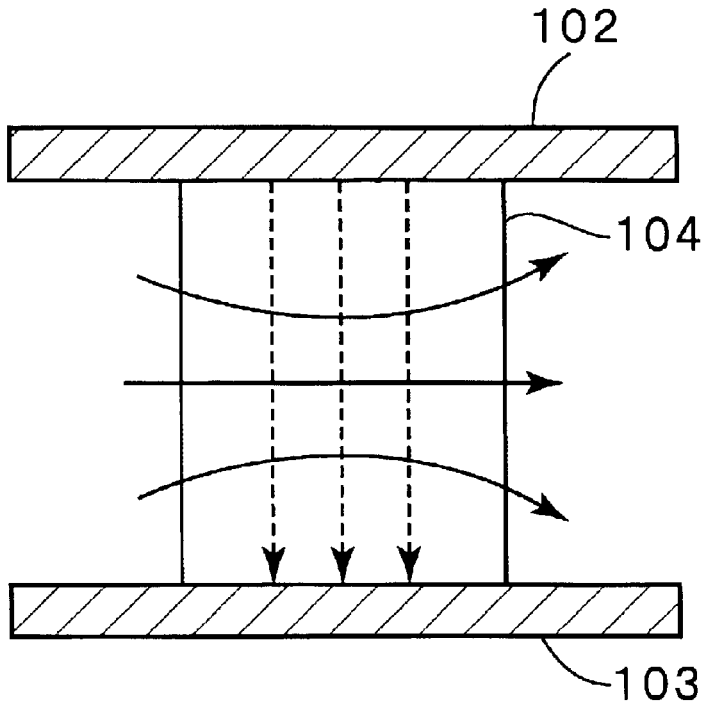
FIG. 20A PRIOR ART
FIGS. 20A and 20B are schematic cross sectional views for explaining electromagnetic field vectors associated with the $LSM_{01}$ mode and $LSE_{01}$ mode according to the related art.
Figure 20B:
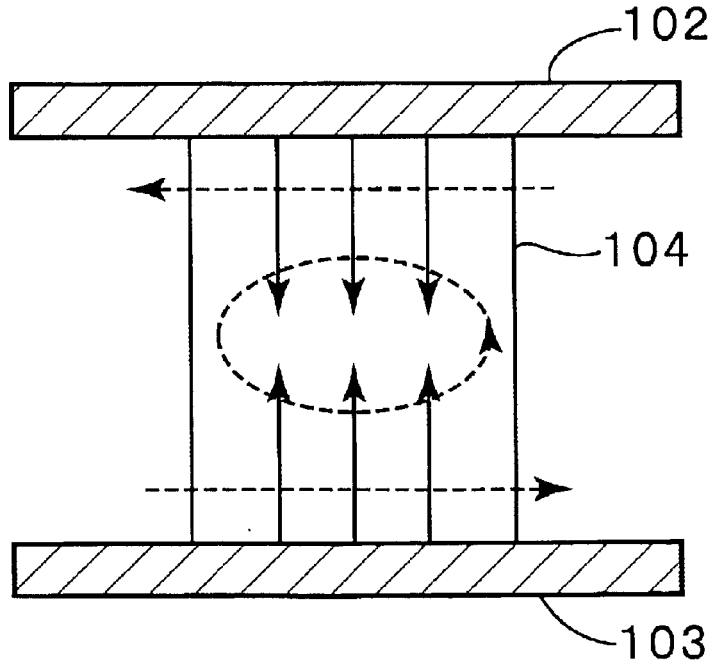
FIG. 20B PRIOR ART
Figure 21A:
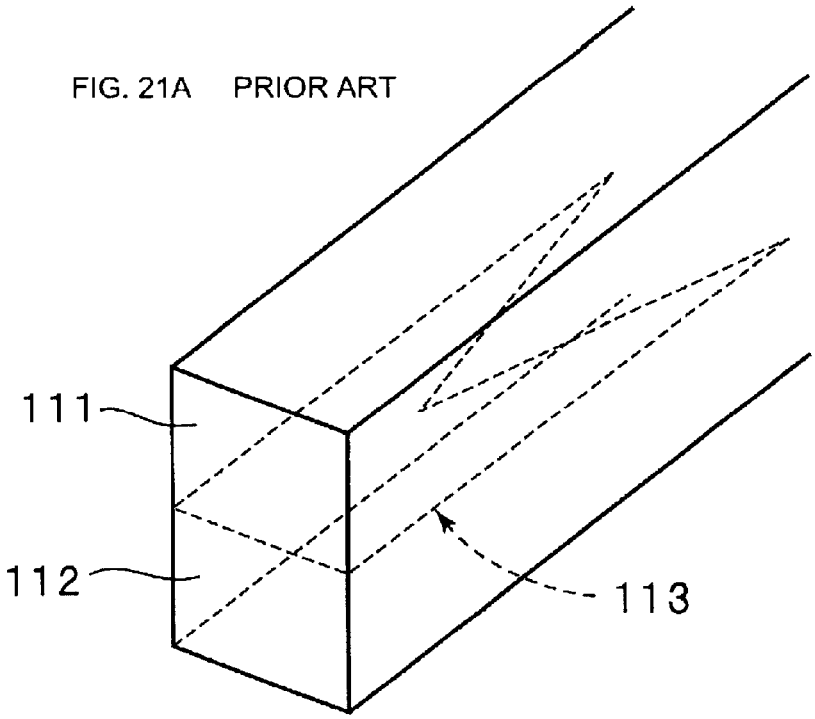
FIG. 21A PRIOR ART
FIG. 21A is a schematic perspective view of an attenuator that is used in a nonradiative dielectric line according to a related art.
Figure 21B:
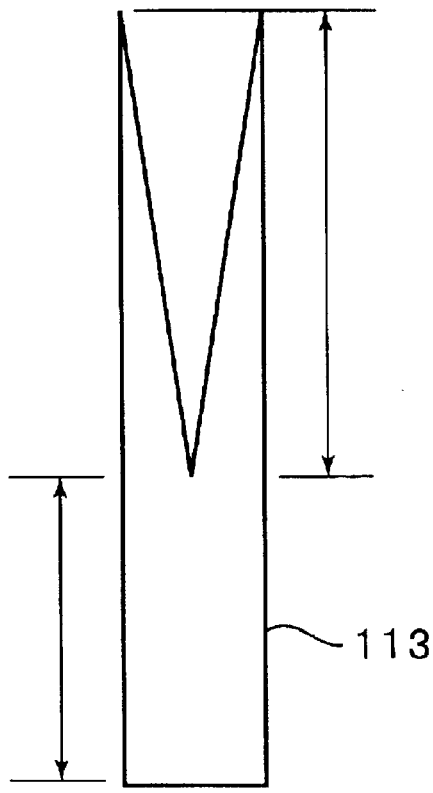
FIG. 21B PRIOR ART
FIG. 21B is a schematic plan view thereof.

The coupler and 0-dB coupler described above may be used, for example, in a communication apparatus shown in FIG. 18. In the communication apparatus shown in FIG. 18, a communication antenna 41 is coupled to a circulator 43 via the 0-dB coupler 31 described above. The circulator 43 is connected to an oscillator VCO and an isolator 44, and the coupler 21 is coupled between the isolator 44 and the circulator 43. The circulator 43 is connected to a mixer 46, and the coupler 21 is also connected to the mixer 46. At the downstream of the mixer 46, an IF amp 47 and a signal processing circuit 48 are provided.

The communication apparatus shown in FIG. 18, which includes the coupler 21 and 0-dB coupler 31 constructed according to the present invention, allows efficient transmission of an operating mode and achieves favorable communication characteristics.

Although the embodiments have been described with an assumption that the $LSM_{01}$ mode is the operating mode and the $LSE_{01}$ mode is an unwanted mode, without limitation to these modes, a high-frequency transmission line according to the present invention may be widely used to suppress unwanted modes in transmission of various transmission modes.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A high-frequency transmission line comprising:

a pair of conductor electrodes;

a dielectric member disposed between said pair of conductor electrodes; and at least one resistive film disposed in a plane that is substantially perpendicular to an electric field of an operating transmission mode of said transmission line, wherein a relationship $t/\delta \leqq 0.1$ is satisfied, where t denotes a thickness of the resistive film in a direction that is substantially perpendicular to the electric field of the operating transmission mode, and δ denotes a skin depth of a current in an operating frequency range.

2. The high-frequency transmission line according to claim 1, wherein a surface resistivity of the resistive film is in a range of 100 $\Omega/mm^2$ to 1,000 $\Omega/mm^2$.

3. The high-frequency transmission line according to claim 2, wherein the surface resistivity of the resistive film minimizes a Q factor of an unwanted mode that is suppressed by the resistive film.

4. The high-frequency transmission line according to claim 1, wherein said pair of conductor electrodes and said dielectric member form a dielectric line structure that allows transmission of the operating transmission mode and that excites a standing wave of an unwanted mode that is to be suppressed, and wherein the resistive film is disposed in the dielectric line structure.

5. The high-frequency transmission line according to claim 4, wherein the resistive film has a length equal to or longer than $\lambda_g/2$, where $\lambda_g$ denotes a wavelength of the unwanted mode.

6. A communication apparatus comprising a high-frequency transmission line according to claim 1.

7. The high-frequency transmission line according to claim 1, further comprising a resistive-film supporting base that supports the resistive film.

8. A coupler comprising a high-frequency transmission line according to claim 1.

9. A high-frequency transmission line comprising:

a pair of conductor electrodes;

a dielectric member disposed between said pair of conductor electrodes; and a resistive film positioned so as to attenuate, by dielectric loss, an unwanted mode having an electric field that is perpendicular to an electric field of an operating transmission mode of said transmission line, wherein a relationship $t/\delta \leqq 0.1$ is satisfied, where t denotes a thickness of the resistive film in a direction that is substantially perpendicular to the electric field of the operating transmission mode, and δ denotes a skin depth of a current in an operating frequency range.

10. The high-frequency transmission line according to claim 9, wherein a surface resistivity of the resistive film is in a range of 100 $\Omega/mm^2$ to 1,000 $\Omega/mm^2$.

11. The high-frequency transmission line according to claim 10, wherein the surface resistivity of the resistive film minimizes a Q factor of the unwanted mode that is suppressed by the resistive film.

12. The high-frequency transmission line according to claim 9, further comprising a resistive-film supporting base that supports the resistive film.

13. The high-frequency transmission line according to claim 9, wherein said pair of conductor electrodes and said dielectric member form a dielectric line structure that allows transmission of the operating transmission mode and that excites a standing wave of an unwanted mode that is to be suppressed, and wherein the resistive film is disposed in the dielectric line structure.

14. The high-frequency transmission line according to claim 13, wherein the resistive film has a length equal to or longer than $\lambda_g/2$, where $\lambda_g$ denotes a wavelength of the unwanted mode.

15. A coupler comprising a high-frequency transmission line according to claim 9.

16. A communication apparatus comprising a high-frequency transmission line according to claim 9.

* * * * *